United States Patent [19]

Dall

[11] 3,943,597

[45] Mar. 16, 1976

[54] VACUUM CLEANER

[75] Inventor: Hans Mathiesen Dall, Glostrup, Denmark

[73] Assignee: A/S Fisker & Nielsen, Copenhagen, Denmark

[22] Filed: Mar. 8, 1974

[21] Appl. No.: 449,563

[30] Foreign Application Priority Data

Mar. 14, 1973 Denmark ..... 1386/73

[52] U.S. Cl. ..... 15/331; 15/339

[51] Int. Cl.[2] ..... A47L 5/14

[58] Field of Search..... 15/300 A, 327 E, 339, 412, 15/413, 331; 417/368, 423 A

[56] References Cited

UNITED STATES PATENTS

| | | | |
|---|---|---|---|
| 3,383,765 | 5/1968 | Meltzer | 15/413 X |
| 3,866,263 | 2/1975 | Crouser et al. | 15/412 |

FOREIGN PATENTS OR APPLICATIONS

| | | | |
|---|---|---|---|
| 1,628,706 | 5/1971 | Germany | 15/339 |

*Primary Examiner*—Stanley N. Gilreath
*Assistant Examiner*—Christopher K. Moore
*Attorney, Agent, or Firm*—Sughrue, Rothwell, Mion, Zinn & Macpeak

[57] ABSTRACT

A vacuum cleaner has a casing with an internal duct connecting the air outlet of the vacuum cleaner fan with a discharge aperture. The casing has one or more primary apertures formed in its wall and communicating through the interior of the casing with one or more secondary apertures in the duct wall, whereby the air flow through the duct induces a secondary flow of ambient air through the primary apertures. This secondary air flow effects a cooling of the casing wall and a reduction of the temperature of the discharged air. An apertured internal partition may be provided for locally reducing the cross-section of the coolant air flow path, thereby insuring a uniform cooling effect upon the casing wall.

7 Claims, 1 Drawing Figure

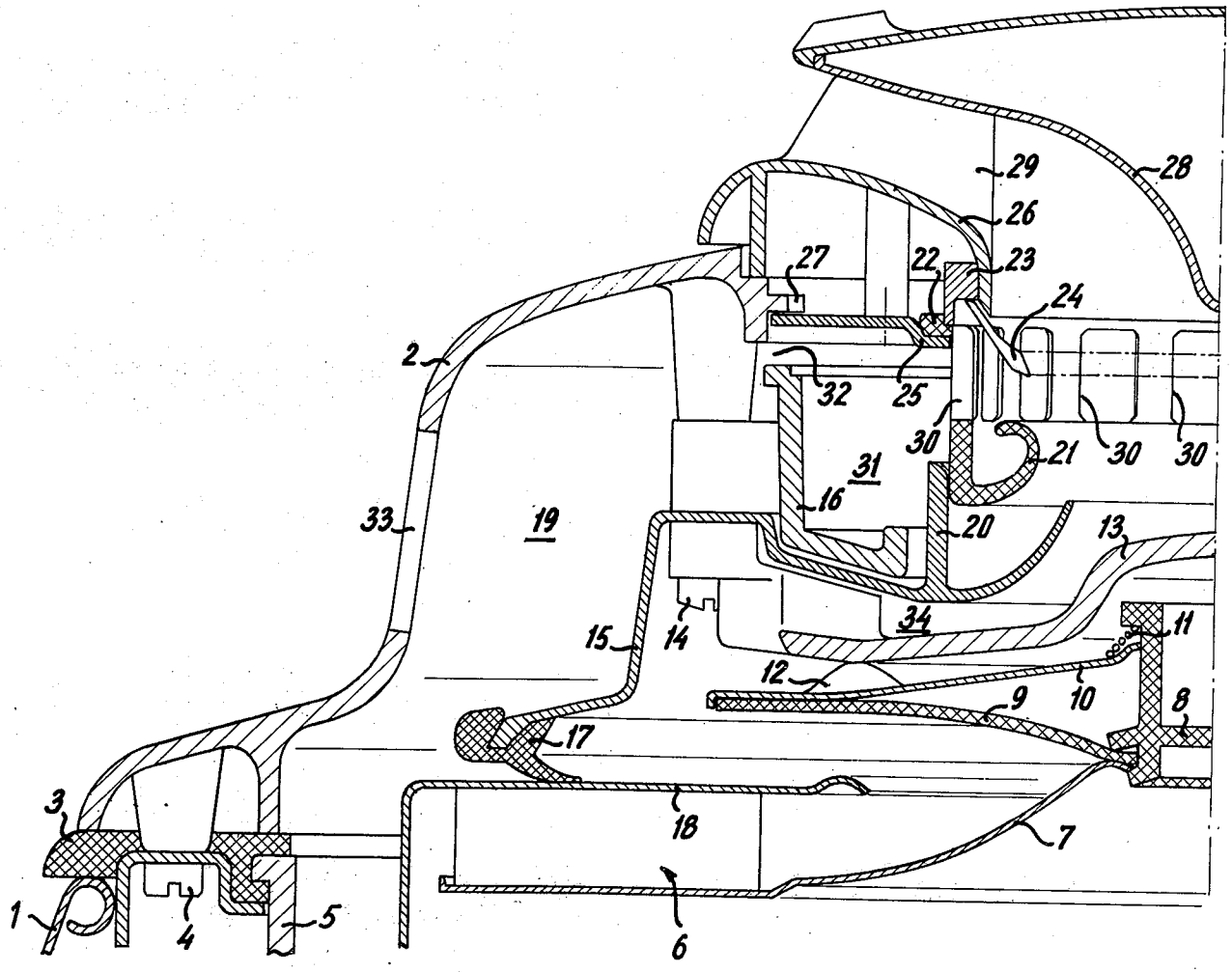
28
29
26
23
24
22
27
30
30
21
25
30
32
31
16
20
13
34
11
8
10
9
12
14
15
19
17
18
7
6
2
33
5
4
3
1

VACUUM CLEANER

BACKGROUND OF THE INVENTION

The present invention relates to a vacuum cleaner of the type comprising a motor-driven fan unit mounted in a casing provided with a discharge aperture which, via an internal duct, communicates with the outlet of the fan unit.

Technical progress made within the field of electromotors have resulted in that normal standard motors - which, inter alia, for economical reasons are preferred in vacuum cleaners - are able to operate at rather high temperatures which, in itself, is advantageous discharge it is then possible to employ motors having small dimensions in relation to their performance and consequently the suction effect of the fan driven by the motor. However, in a vacuum cleaner, a high motor temperature results in a correspondingly high temperature of the filtered air discharged from the vacuum cleaner. The high air temperature can in itself be unpleasant for the person operating the vacuum cleaner who easily gets in the way of the hot air stream, but it has also the disadvantage that it causes a heating of the wall of the vacuum cleaner casing around the dicharge aperture, which wall can become so hot that the operator runs the risk of getting burned when touching it. This is particularly the case when the casing wall is made of metal which often is most expedient with a view to the mechanical strength and/or to the manufacturing costs.

BRIEF SUMMARY OF THE INVENTION

According to the present invention there is provided a vacuum cleaner comprising a motor-driven fan unit mounted in a casing having an unobstructed discharge aperture and internal duct means defining a first air flow passage connecting said discharge aperture with the outlet of said fan unit, the vacuum cleaner being provided with at least one primary aperture in an outer wall of said casing spaced from said discharge aperture, and at least one secondary aperture in a wall of said internal duct means, which primary and secondary apertures communicate by way of a second air flow passage extending through the interior of said casing.

The invention has the advantage that the stream of air flowing out from the fan outlet to the surroundings via the internal duct induces a current of relatively cold ambient air which flows via the primary aperture or apertures, the interior of the casing and the secondary aperture or apertures into the duct where it gets mixed with the stream of air from the fan unit. As a consequence thereof, the air discharged from the vacuum cleaner becomes colder and hence less unpleasant to the person operating the vacuum cleaner. In addition, the current of cold air flowing through the interior of the casing effects a substantial cooling of the outer wall of the casing. It has been found possible in practice to reduce the wall temperature from approximately 70°C (without the supplementing air current) to approximately 30°C, that is to say, to a "hand-warm" temperature at which the casing is not too hot to touch.

Danish Pat. specification No. 85.010 discloses a vacuum cleaner having an annular aperture in the wall of the casing surrounding the centrally located discharge aperture and a flow passage between the annular aperture and the discharge passage from the fan. A flap valve fitted in the exhaust aperture is mechanically opened by the vacuum cleaner hose when the hose is introduced into the aperture, that is to say, when the vacuum cleaner is to be used for blowing, but during normal operation of the vacuum cleaner the valve closes automatically and acts as a non-return valve so that the discharge air is exhausted via the annular aperture, whereby the air velocity becomes relatively low, due to the relatively large area of that aperture. The annular aperture thus acts very much like a diffuser and thus has an entirely different function from that of the above-mentioned primary aperture or apertures formed, according to the invention, in the outer wall of the casing.

With a view to insuring uniform cooling of the outer wall of the casing, it is expedient that several secondary apertures are evenly distributed along the circumference of the duct wall, whereby the flow of ambient air sucked in through the primary aperture or apertures is caused to flow along the entire inside surface of the casing wall.

The secondary aperture or apertures may be formed in an area of the duct wall that becomes obstructed by a hose associated with the vacuum cleaner when this hose is inserted into the discharge aperture. The vacuum cleaner hose then automatically acts as a non-return valve so that a loss of air through the flow path including the interior of the casing and the primary aperture or apertures is avoided when the vacuum cleaner is used for blowing. Alternatively, the same effect could be achieved by means of suitably mounted non-return valves, for instance, associated with the primary apertures.

The primary aperture or apertures may be located in a wall portion of the casing extending approximately parallel to the axis of the duct, which results in a minimum of directional change and loss of power in the cooling air current and, hence, in an optimum of utilization of the ejector effect of the exhaust air from the fan.

In order to achieve the uniform internal cooling of the casing wall mentioned above, it is expedient to provide a circumferential partition in the casing between the primary and the secondary apertures and at least one slot in the portion of this partition which is located adjacent the outer wall of the casing. There may be provided a plurality of such slots evenly distributed along the circumference of the partition.

The effect of said slot or slots can be further enhanced by dimensioning the slot or slots so that the total flow area thereof is smaller than the total flow area of the secondary aperture or apertures. In this case a substantial part of the flow resistance encountered by the current of cooling air or the individual part currents thereof and the resulting pressure drop occurs in the slot or slots, and it is possible, even with a single primary aperture, to achieve that the pressure externally of the partition becomes constant along the entire circumference thereof and that consequently the part currents flowing to the individual secondary apertures or to individual sections of a continuous secondary aperture become substantially equal. When only a single primary aperture or a couple of primary apertures are to be formed in the wall of the casing, the tool for producing the aperture or apertures becomes correspondingly simpler and less expensive, irrespective of whether the apertures are punched out of a metal casing or formed with the aid of the mould parts of a plastics mould.

BRIEF DESCRIPTION OF THE DRAWING

An embodiment of the vacuum cleaner according to the invention will now be described in more detail with reference to the accompanying shematic drawing which shows a half axial section through the vacuum cleaner casing portion that contains the discharge passage from the fan.

DETAILED DESCRIPTION

The vacuum cleaner illustrated in the drawing is a so-called vertical vacuum cleaner, the casing of which comprises a main portion 1, of which the drawing merely shows an upper curled-back edge bead, and a cover portion 2. During operation of the vacuum cleaner the two casing portions, both of which can be fabricated from metal, are detachably clamped together with the aid of locking means (not shown), and a sealing ring 3 is clamped between the portions. Screws 4 serves to secure the sealing ring 3 and a casing 5 for the fan and driving motor (not shown) of the vacuum cleaner to cover 2. The fan may, for example, be a two-stage centrifugal fan provided with a baffle device 6 consisting of appropriately shaped, stationary vanes downstream of the second stage of the fan. The general construction of the vacuum cleaner will be apparent, in principle, from British Pat. No. 740.199, issued to the assignee of the present invention and incorporated by reference in the present specification.

Baffle device 6 comprises an annular supporting plate 7 for the vanes, and an annular flap valve, which automatically closes the exhaust aperture of the baffle device when the fan is stopped, is mounted on a bushing 8 inside the central orifice of plate 7. The valve consists of an annular disc 9 of cloth which, at its outer circumference, is secured to a metal plate 10 guided along bushing 8 and biased against the closed position by a spring 11. The lift of the valve is limited by one or more projections 12 on plate 10, which abut against a transverse partition 13, as shown in the drawing.

Partition 13 is, together with another annular partition 15 and a cup-shaped insert 16, secured to cover 2 by means of screws 14. Along its circumference, partition 15 carries an annular seal 17 engaging the upper supporting plate 18 of baffle device 6 so as to seal the space 19 located inside cover 2 from the outlet of the fan unit. The inner periphery of partition 15 terminates in an upwardly curved annular flange 35, forming a flow restriction with respect to the area above the flange.

The partition 15 mentioned above is provided with an upwardly projecting annular portion 20, and a sleeve 21 made of rubber or a similar elastic material is mounted with a tight fit against the inside of annular portion 20. Sleeve 21 has an outwardly projecting top flange 22, and by means of a clamping ring 25 and a plurality of screws (not shown) a locking ring 23, which is coaxial with the sleeve and formed with a circular series of downwardly and inwardly directed tongues 24, is secured, together with sleeve 21, to a top cap 26 mounted above the central orifice of cover 2. The circumference of clamping ring 25 is constructed as a bayonet lock that interacts with projections 27 along the central orifice of cover 2 in such a way that the top cap, together with the sleeve and the locking ring, can be mounted and dismantled as a unit.

The locking ring 23 with its tongues 24 mentioned above serves for detachably retaining a vacuum cleaner hose inserted into the central aperture of the cap 26, and the construction and function of the locking ring become apparent in greater detail from Danish pat. specification No. 86.404. During normal operation of the vacuum cleaner, when the hose is inserted into the suction aperture (not shown) in the main portion of casing 1, a detachable diffuser 28 may be mounted above top cap 26, as shown in the drawing, and the diffuser may be provided with U-shaped retaining means (not shown) which engage with ribs 29 projecting upwardly from the upper side of the top cap 26. The ribs 29 thus serve, on the one hand, to retain diffuser 28 and, on the other hand, to divide the discharge air current into several substantially horizontally flowing part currents.

In its circumference, sleeve 21 has a number of evenly distributed and preferably equally large apertures 30 through which the central aperture in top cap 26 mentioned above communicates with an annular chamber 31 between the sleeve and insert 16. As shown, the height of the insert is such that, between it and the underside of cover 2, a relatively narrow slot 32 is formed, which connects annular chamber 31 with the aforementioned space 19. This space communicates with the surrounding atmosphere via one, or if desired, more apertures 33 in the cover 2.

During the normal suction operation of the vacuum cleaner shown, the air volume discharged by the fan flows from baffle device 6 below the raised valve disc 9, further through the gap 34 between the two partitions 13 and 15, upwards through the flow restriction of flange 35, and out between top cap 26 and diffuser 28. The air passing through the flow restriction produces a partial vacuum in the space peripherally above the top of the flange, which by suction induces a secondary current of air from the surrounding atmosphere via aperture or apertures 33 in cover 2, slot 32 and the evenly distributed apertures 30 in sleeve 21. As mentioned earlier, this secondary current of relatively cold air gives rise, on the one hand, to a reduction in the temperature of the relatively hot air discharged from the fan and, on the other hand, to a reduction in the surface temperature of cover 2. As likewise indicated above, slot 32 is expediently so narrow that the major part of the flow resistance to said secondary air current occurs in the slot, which contributes towards insuring uniform pressure along the entire external circumference of insert 16 and thereby also by and large equal air flow velocities through each of the apertures 30 and, hence, also a fairly even distribution of the air current along the inside of cover 2.

When the vacuum cleaner is used for blowing, diffuser 28 is removed and a vacuum cleaner hose is inserted into sleeve 21, whereby tongues 24 serve to prevent the hose from being inadvertently pulled out. The inwardly facing curled-back portion of resilient sleeve 21 is hereby expanded radially by the end of the hose or hose coupling inserted into the sleeve and thus closes the secondary flow passage via apertures 30 so that the air volume delivered by the fan is discharged in its entirety via the attached hose.

I claim:

1. In a vacuum cleaner comprising a motor-driven fan unit mounted in a casing having an unobstructed discharge aperture, internal duct means defining a first air flow passage connecting said discharge aperture with the outlet of said fan unit, and a flow restriction in said first air flow passage intermediate the ends thereof, the improvement comprising the provision of at least one primary air inlet aperture in an outerwall of said casing spaced from said discharge aperture and at least one secondary aperture in a wall of said internal duct means, which primary and secondary apertures communicate by way of a second air flow passage extending through the interior of said casing, said secondary aperture being provided downstream of said flow restriction in an area of said wall, which is obstructed by a hose coupling associated with the vacuum cleaner, when said hose coupling is inserted in said discharge aperture.

2. A vacuum cleaner as claimed in claim 1, wherein a plurality of secondary apertures are evenly distributed along the circumference of said wall of the internal duct means.

3. A vacuum cleaner as claimed in claim 1, wherein said primary aperture is provided in a portion of said casing wall which extends approximately parallel to the axis of said first air flow passage.

4. A vacuum cleaner as claimed in claim 1, further comprising a circumferential partition located within said casing between said primary and secondary apertures and at least one slot in said partition adjacent to the wall of said casing, said slot forming part of said second air passage.

5. A vacuum cleaner as claimed in claim 4, wherein said slot is defined between a circumferential edge of said partition and the inside of said casing wall.

6. A vacuum cleaner as claimed in claim 4, wherein the flow area of said slot is smaller than the flow area of said secondary aperture.

7. A vacuum cleaner as claimed in claim 4, wherein a plurality of slots are evenly distributed along the circumference of said partition.

* * * * *